US011041323B2

(12) United States Patent
Hejazi et al.

(10) Patent No.: US 11,041,323 B2
(45) Date of Patent: Jun. 22, 2021

(54) VISCOELASTIC BRACING DAMPER

(71) Applicant: Universiti Putra Malaysia, Serdang (MY)

(72) Inventors: Farzad Hejazi, Selangor (MY); Mohd Saleh Jaafar, Selangor (MY)

(73) Assignee: Universiti Putra Malaysia, Selangor (MY)

( * ) Notice: Subject to any disclaimer, the term of this patent is extended or adjusted under 35 U.S.C. 154(b) by 0 days.

(21) Appl. No.: 16/433,300

(22) Filed: Jun. 6, 2019

(65) Prior Publication Data

US 2019/0376306 A1 Dec. 12, 2019

(30) Foreign Application Priority Data

Jun. 6, 2018 (MY) ..... PI2018702232

(51) Int. Cl.
*E04H 9/02* (2006.01)

(52) U.S. Cl.
CPC ..... *E04H 9/027* (2013.01); *E04H 9/021* (2013.01); *E04H 9/0215* (2020.05)

(58) Field of Classification Search
CPC .... F16F 7/09; F16F 3/0873; F16F 7/00; F16F 7/087; E04H 9/02; E04H 9/028; E04H 9/021; E04H 9/027; E04B 1/98; E04B 1/985
USPC .... 267/134, 201, 136, 219, 64.15; 52/167.3, 52/167.1, 167.8
See application file for complete search history.

(56) References Cited

U.S. PATENT DOCUMENTS 4,750,719 A * 6/1988 Hartel ..... F16F 13/18 267/219
5,183,137 A * 2/1993 Siwek ..... F16F 7/09 188/129
5,308,675 A * 5/1994 Crane ..... E04C 3/29 181/208
6,609,682 B2 * 8/2003 Rogers ..... B64C 25/64 188/129
6,820,867 B2 * 11/2004 Satori ..... F16F 13/108 267/140.13
7,182,187 B2 * 2/2007 Mochimaru ..... F16F 9/303 188/297
8,002,093 B2 * 8/2011 Mochimaru ..... F16F 9/303 188/297
8,038,133 B2 * 10/2011 McPherson ..... F16L 9/21 173/162.2

(Continued)

*Primary Examiner* — Brent W Herring
*Assistant Examiner* — Daniel J Kenny
(74) *Attorney, Agent, or Firm* — Cesari & McKenna, LLP

(57) ABSTRACT

The present invention relates to a viscoelastic bracing damper (100), comprising: a cylinder (101); an inner core (102) extended through the cylinder (101) without contacting an inner surface of the cylinder (101), thereby having a barrel portion formed between the inner surface of the cylinder (101) and the inner core (102); a joint (103) connecting a front connector (104) to one end of the inner core (102); a stopper (105) connecting an end connector (106) to an another end of the inner core (102); and characterised by a damping means (107) extended substantially along a length of the barrel portion; wherein the damping means (107) is compressed between the inner surface of the cylinder (101) and the inner core (102) for absorbing vibration loads.

3 Claims, 5 Drawing Sheets

(56) References Cited

U.S. PATENT DOCUMENTS

| | | | | |
|---|---|---|---|---|
| 8,844,205 | B2 * | 9/2014 | Michael | F16F 9/303 52/1 |
| 9,004,466 | B2 * | 4/2015 | Barnes | B64C 27/001 267/140.13 |
| 2019/0118959 | A1 * | 4/2019 | Vinjanampati | F16F 7/09 |

* cited by examiner

VISCOELASTIC BRACING DAMPER

CROSS REFERENCE TO RELATED APPLICATION

This application claims priority to Malaysian Application No. PI 2018702232, filed on Jun. 6, 2018. The contents of which are hereby incorporated by reference in their entirety.

BACKGROUND OF THE INVENTION

Field of the Invention

This invention relates to a bracing damper, more particularly relates to a viscoelastic bracing damper that is embedded in or placed between structural frames in order to increase the damping of structure to improve their performance by dissipating part of dynamic load due to earthquake, wind or any source of vibrations.

Description of Related Arts

The damage due to lateral hazard activity disasters such as seismic, wind, or vibration cannot be fully avoided. However, the effects can be considerably subdued by applying the proper supplementary devices. In order to diminish said hazard effect, extensive efforts have been constantly keen by engineers and researchers in the structural engineering fields. Recognized to the growing efforts, methods for withstand of building's constructions against seismic activity have increasingly developed and expanded over the years. At early-on seismic design move towards focuses on evading of structural breakdown, to which reliance is frequently located on the design of structural flexibility to dissipate generous energy by suffering huge inelastic deformation.

Energy absorption structures are widely used in many constructions wherein installed in specified locations such as structural frames to absorb vertical and horizontal forces from the weight of the building itself, earthquakes or any vibrations. Various researches on utilizing further damping devices to increase the energy dissipation capacity of structures have been under taken over the past decades. In general, all the energy dissipating devices are capable of enhancing the energy dissipation in the structural systems in which they are installed. This may be achieved by conversion of kinetic energy to one or more of the following forms such as heat, frictional sliding, yielding of metals, phase transformation in metals and deformation of viscoelastic solids or fluids.

Application of damping in a structure is improving the response and performance of the structure under earthquake vibration, wind forces or any hazard of similar nature. Vibrating could be diminished with installation said damping in structure. This damping is the result of factors such as the inter story drift and base shear of structures. The typical damping in a structure could be roughly varied between 2% to 7% in the fundamental mode of vibration. Therefore, the increase of structural damping has led to raise the survivability of the structure and the protection of occupants indoors.

In recent days, there are many type of damping used as energy dissipating material such as friction dampers, viscoelastic dampers, yielding metal dampers, fluid viscose dampers and et cetera. The friction dampers dissipate energy as a result of the friction between two metal surfaces, and have the disadvantage of deterioration when the friction surfaces deteriorate with the repeated use and time.

Viscoelastic damper performance deteriorates with the changes in temperature and large strains. Yielding metal dampers dissipate energy due to the nonlinear deformation in the metal after yielding, it has the disadvantage of having residual strain in the metal due to the yielding, which make it less efficient or it might fail due to the repeated yielding and residual strains. Fluid viscous dampers have the disadvantage of being too expensive and the fluids might leak during the long life of the structures.

Rubber material is a high damping performance when subjected to oscillation. As a result, the damping can be increased substantially to a desirable value in the fundamental mode of vibration with the application of rubber material in a structure. Accordingly, the performance of structures is improved by reduction in the lateral movement, reduction in the base shear, reduction in the stress in the structural members and joints. However, said rubber material damper have to sustain various stresses such as normal stress, shear stress and torsion stress. The conventional dampers are mostly emphasized absorption of shear stress only while dealing with more complicated situation, the efficiency of energy absorption may decline, and the dampers may become unstable. Therefore, the conventional damper will only have limited effect for earthquake protection.

U.S. Pat. No. 6,931,800 B2 has disclosed a passive supplemental damping devices used to supplement and increase the damping in structures. The damper for insertion between the interior beams and columns of a building comprising: a first plate affixed to the beam and a second plate affixed to the column; a viscoelastic material interposed between said first plate and said second plate; a third and fourth plate parallel to each other, said third plate projecting perpendicularly from the end of said first plate and adapted to be affixed to the interior beam of said building, said fourth plate affixed to said second plate; and wherein said viscoelastic material is interposed between, and bonded to, said third and fourth plates. The viscoelastic material comprises rubber is bonded to steel and connect the device to the structure frame. The rubber is increasing the damping in the structure and intern to dissipate energy. However, said supplemental damping devices may have limited shear area of beam and column which may cause lesser shear strength. This is because the device is placed on top of bracing members or shear walls, in the bracing members themselves, intersection of bracing members and at the joints of beam to column connections.

China Patent Application No. 205576722 U has disclosed a damping device for bridge. Said damping device is a viscoelastic dampers comprises rubber sleeve, elastic column of the stiffening plate and elastomeric columns. The damping device is simple in structure, simple to operate, low cost, maintenance is simple and convenient, effective shock attenuation energy dissipation, double shock absorption reaches optimizing shock attenuation effect, prolonged life and low maintenance cost. However, said damping device may have limited shear area and therefore reduce of shear strength and decline efficiency of energy absorption.

None of the prior arts presents the features as in the teaching of the present invention. Accordingly, it can be seen in the prior arts that there is a need to provide a viscoelastic bracing damper for increasing the damping of structure to improve their performance by dissipating part of dynamic load due to earthquake, wind or any source of vibrations.

SUMMARY OF INVENTION

It is an objective of the present invention to provide a bracing damper with high damping visco-elastic material for absorbing dynamic or vibration loads due to earthquakes, wind or any source of vibrations.

It is also an objective of the present invention to provide a bracing damper with high shear stiffness to reduce inter-story drift due to imposed lateral vibrations.

It is yet an objective of the present invention to provide a viscoelastic bracing damper that takes advantage of using low cost material.

Accordingly, these objectives may be achieved by following the teachings of the present invention. The present invention relates to a viscoelastic bracing damper (100), comprising: a cylinder (101); an inner core (102) extended through the cylinder (101) without contacting an inner surface of the cylinder (101), thereby having a barrel portion formed between the inner surface of the cylinder (101) and the inner core (102); a joint (103) connecting a front connector (104) to one end of the inner core (102); a stopper (105) connecting an end connector (106) to an another end of the inner core (102); and characterised by a damping means (107) extended substantially along a length of the barrel portion; wherein the damping means (107) is compressed between the inner surface of the cylinder (101) and the inner core (102) for absorbing vibration loads.

BRIEF DESCRIPTION OF THE DRAWINGS

The features of the invention will be more readily understood and appreciated from the following detailed description when read in conjunction with the accompanying drawings of the preferred embodiment of the present invention, in which.

DETAILED DESCRIPTION OF THE INVENTION

Figure 1:
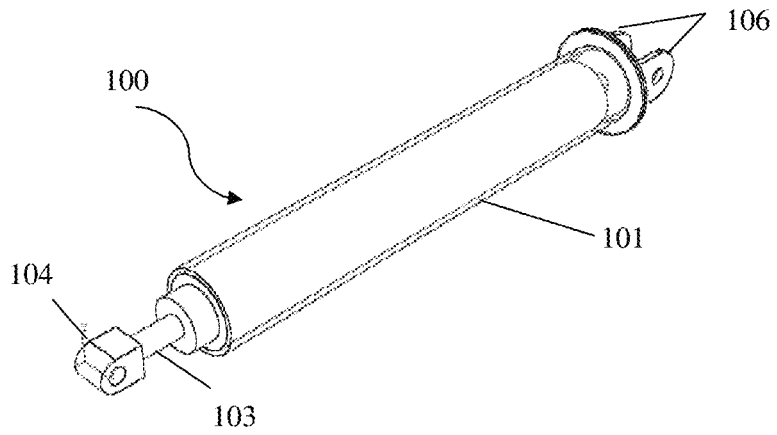
FIG. 1 shows a viscoelastic bracing damper.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting but merely as a basis for claims. It should be understood that the drawings and detailed description thereto are not intended to limit the invention to the particular form disclosed, but on the contrary, the invention is to cover all modifications, equivalents and alternatives falling within the scope of the present invention as defined by the appended claims. As used throughout this application, the word "may" is used in a permissive sense (i.e., meaning having the potential to), rather than the mandatory sense (i.e., meaning must). Similarly, the words "include," "including," and "includes" mean including, but not limited to. Further, the words "a" or "an" mean "at least one" and the word "plurality" means one or more, unless otherwise mentioned. Where the abbreviations or technical terms are used, these indicate the commonly accepted meanings as known in the technical field. The present invention will now be described with reference to FIGS. 1-9.

The present invention presents viscoelastic bracing damper (100), comprising:

- a cylinder (101);
- an inner core (102) extended through the cylinder (101) without contacting an inner surface of the cylinder (101), thereby having a barrel portion formed between the inner surface of the cylinder (101) and the inner core (102);
- a joint (103) connecting a front connector (104) to one end of the inner core (102);
- a stopper (105) connecting an end connector (106) to an another end of the inner core (102); and characterised by

- a damping means (107) extended substantially along a length of the barrel portion;
- wherein the damping means (107) is compressed between the inner surface of the cylinder (101) and the inner core (102) for absorbing vibration loads.

In a preferred embodiment of the present invention, the damping means (107) is a viscoelastic material comprises rubber such as isoprene, ethylene propylene diene (EPDM) or polybutadiene.

In a preferred embodiment, the viscoelastic material is mounted between the inner core (102) and cylinder (101) and bonded to both surfaces as energy dissipator members to absorb vibration loads.

According to the present invention, the front connector (104) and end connector (106) comprises hinges for installation the viscoelastic bracing damper (100) to a structure or bridge joints. The stopper (105) is connecting the end connector to one end of inner core (102) for limiting the excess lateral movement of structure under any source of excitation or vibration.

During structural movement, the vibration is transferred from structure joints to the hinge connection of viscoelastic bracing damper (100) and cause the inner core (102) to move within the cylinder (101). The damping means (107) between the inner core (102) and cylinder (101) dissipates the vibration effect by shear stiffness and damping action of the damping means (107).

The resistant and damping force of viscoelastic bracing damper (100) is depend on properties of the damping means (107) between the inner core (102) and the cylinder (101). The damping means (107) is compressed between the inner surface of the cylinder (101) and the inner core (102) to reduce inter-story drift due to imposed lateral vibration. The damping means (107) increases the shear stiffness so as to increase the shear resistant force.

In a preferred embodiment, the viscoelastic bracing damper (100) is not limited to be used for building, vessel, vehicle, bridge, machinery only but can be used for any structures subjected to dynamic loads and vibration.

Below is the example of the viscoelastic bracing damper (100) for dissipating part of energy of the dynamic load or vibration load, from which the advantages of the present invention may be more readily understood. It is to be understood that the following examples are for illustrative purpose only and should not be construed to limit the present invention in any way.

EXAMPLE

Figure 2:
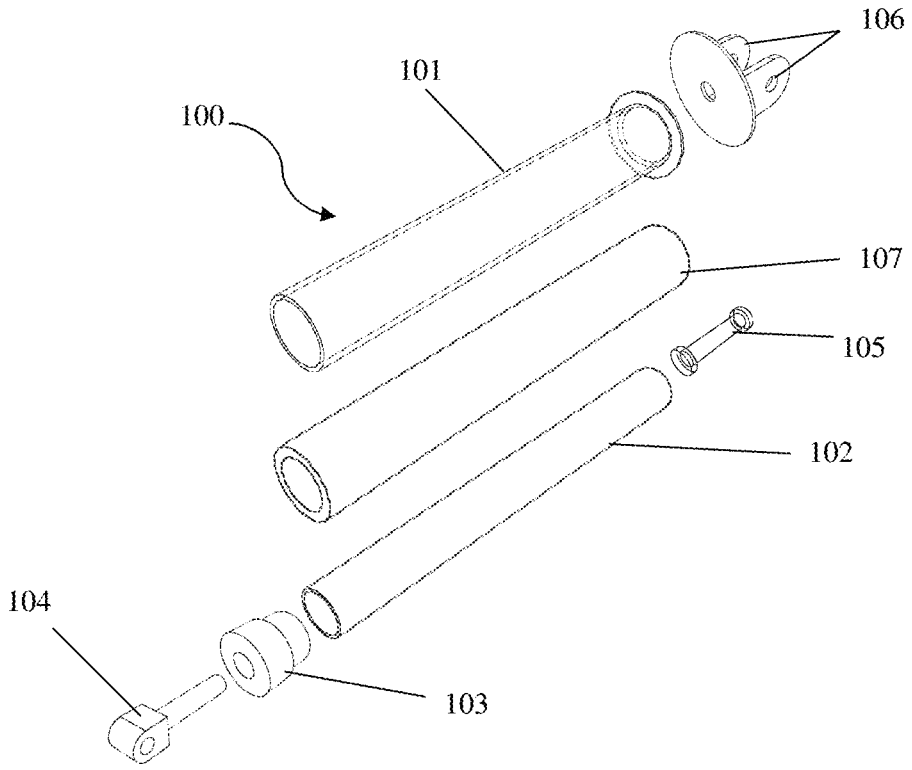
FIG. 2 shows an exploded view of the viscoelastic bracing damper in FIG. 1.

A viscoelastic bracing damper (100) for dissipating part of energy of the dynamic load or vibration load was developed and shown in FIGS. 1-2. Referring to FIGS. 1-2, the viscoelastic bracing damper (100) comprises a cylinder (101) has an inner core (102) transversed therethrough without contacting an inner surface of the cylinder (101), thereby having a barrel portion formed between the inner surface of the cylinder (101) and the inner core (102). A damping means (107) is extended substantially along a length of the barrel portion, herein the damping means (107) is compressed between the inner surface of the cylinder (101) and the inner core (102) for absorbing vibration loads. A front connector (104) and an end connector (106) are attached separately to each end of the inner core (102) for installing the viscoelastic bracing damper (100) to a structure joint.

Figure 3:
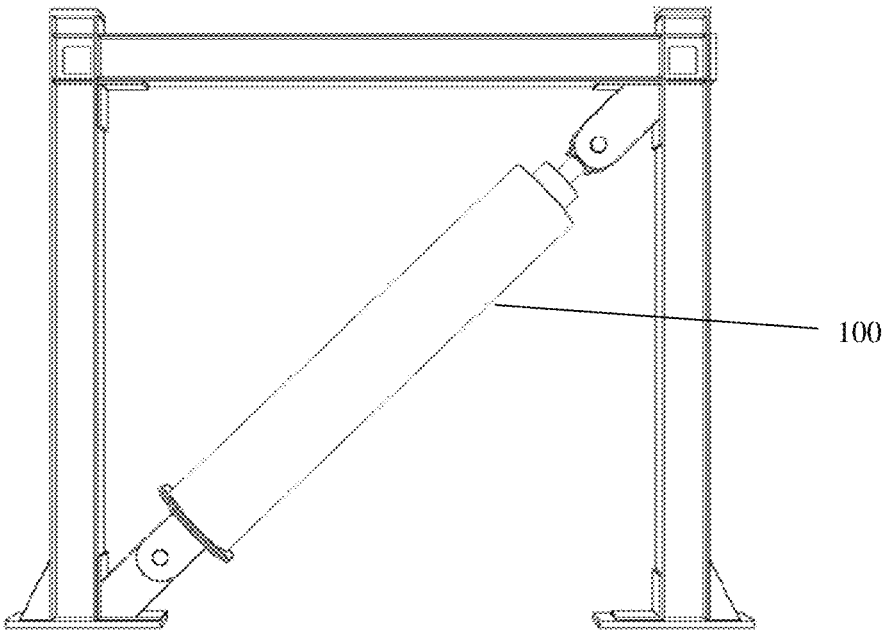
FIG. 3 shows viscoelastic bracing damper installed to a frame structure.

FIG. 3 shows a viscoelastic bracing damper (100) is installed to a frame structure connected by a front connector (104) and end connector (106).

Figure 4:
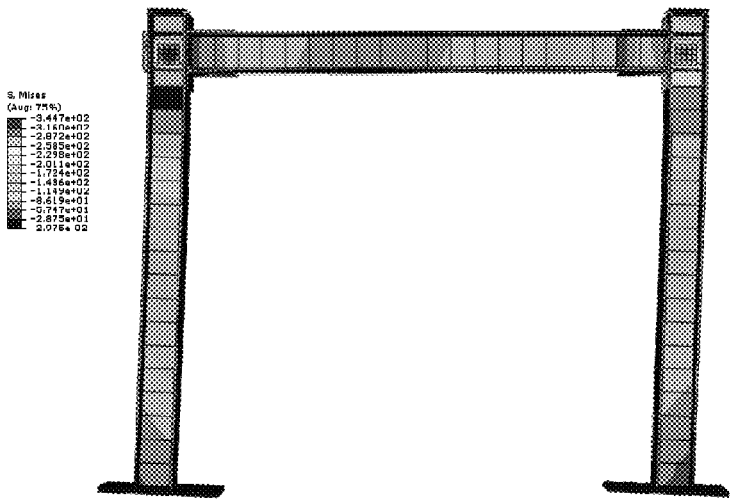
FIG. 4 shows a steel bare frame structure.
Figure 5:
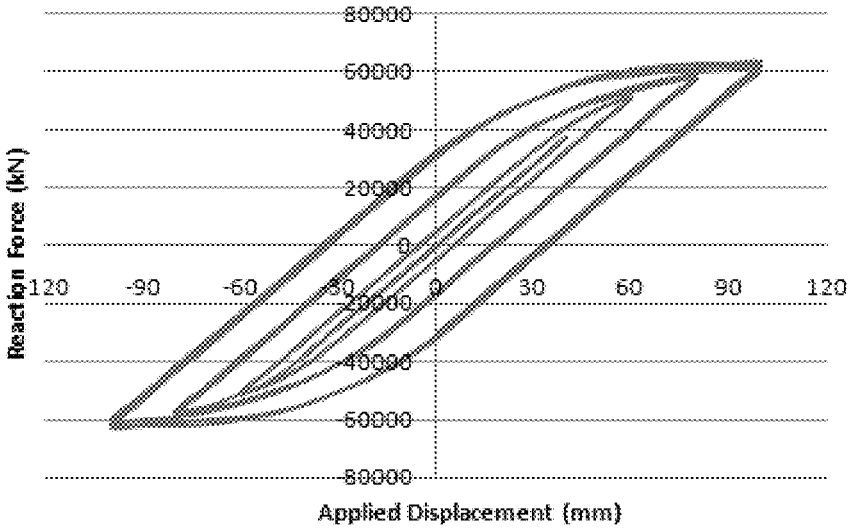
FIG. 5 shows a graph of reaction force with applied displacement for steel bar frame structure subjected to lateral cyclic load in FIG. 4.

FIG. 4 shows a steel frame structure and FIG. 5 shows a graph of reaction force with applied displacement for steel bare frame structure in FIG. 4. The steel bare frame as shown in FIG. 4 is without any bracing or damper and therefore high displacement is shown in FIG. 5.

Figure 6:
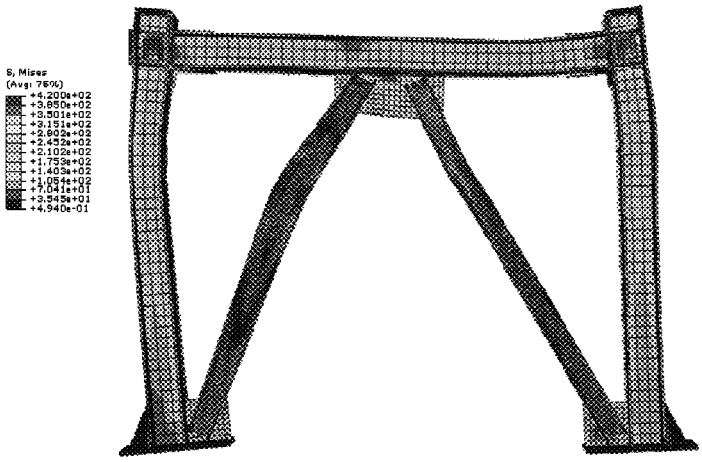
FIG. 6 shows a steel frame with chevron bracing structure subjected to lateral cyclic load.
Figure 7:
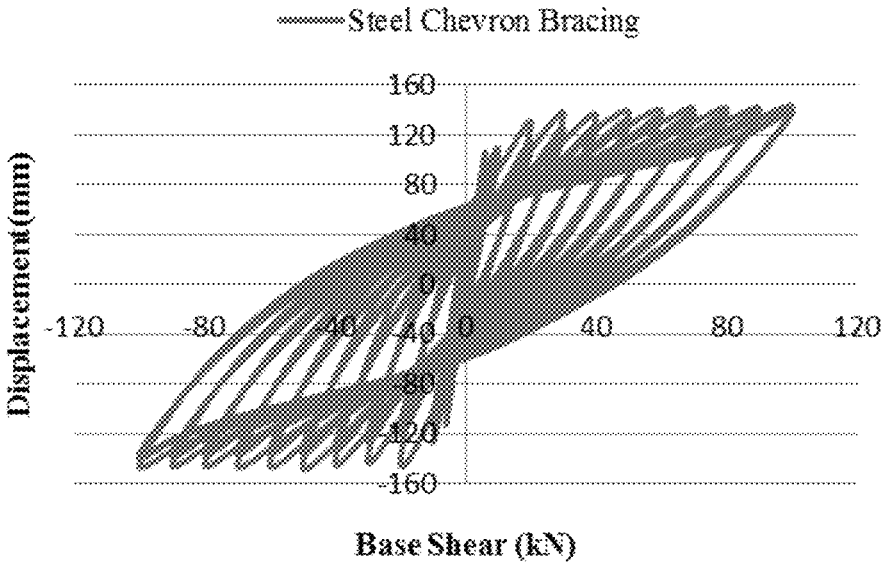
FIG. 7 shows a graph of displacement with base shear for steel frame with chevron bracing structure subjected to lateral cyclic load in FIG. 6.
Figure 8:
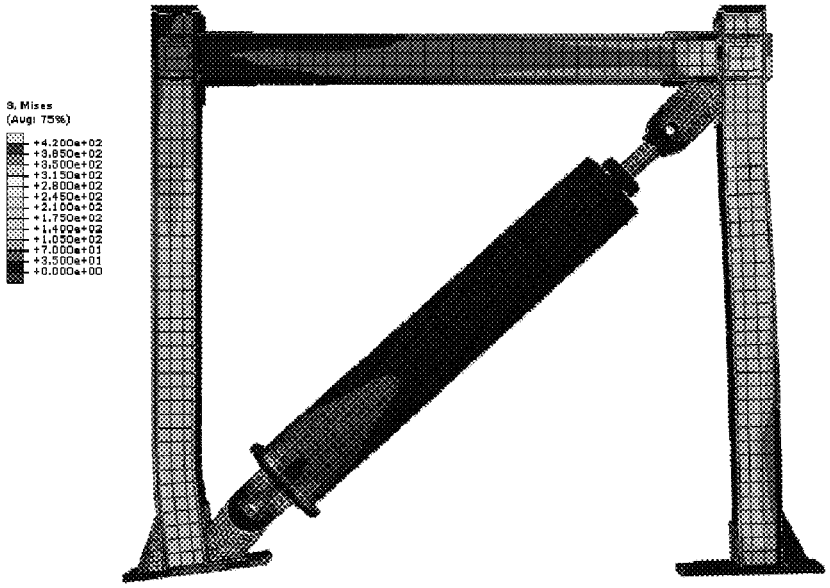
FIG. 8 shows a steel frame with viscoelastic bracing damper subjected to lateral cyclic load.
Figure 9:
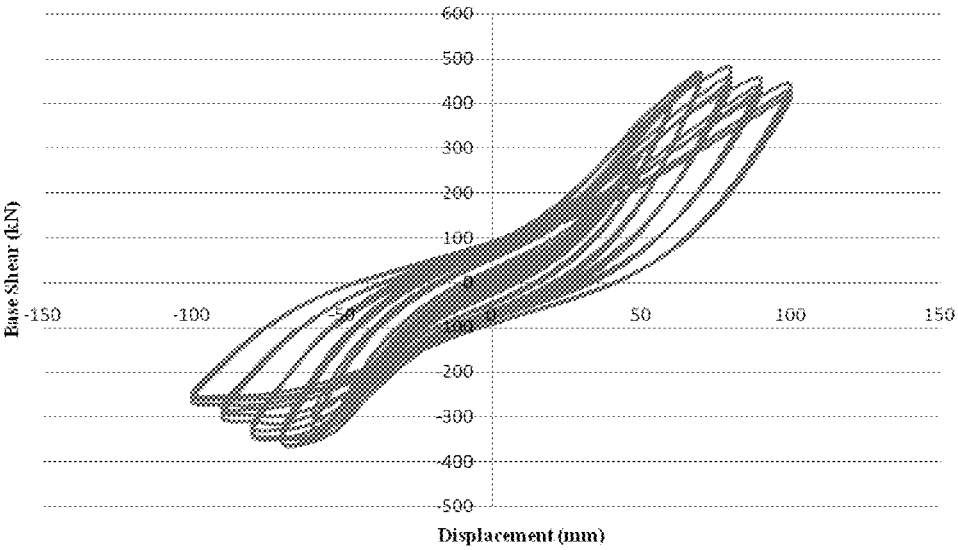
FIG. 9 shows a graph of base shear with displacement for steel frame with viscoelastic bracing damper in FIG. 1 subjected to lateral cyclic load in FIG. 8.

FIG. 6 shows a steel frame with chevron bracing subjected to lateral cyclic load. The steel frame is slightly destroyed as shown in FIG. 6 due to lateral cyclic displacement. FIG. 7 shows the result of displacement with base shear for steel frame in FIG. 6. According to the result in FIG. 6, excessive displacement and unstable base shear are shown. In contrast, a steel frame with viscoelastic bracing damper (100) subjected to lateral cyclic load is shown in FIG. 8. The steel frame with viscoelastic bracing damper (100) in FIG. 8 shows less destruction in comparison with FIG. 6. FIG. 9 shows the result of base shear with displacement for steel frame in FIG. 8. Referring to FIG. 9, the base shear and displacement are showing better performance during cyclic movement in comparison with the result for steel frame with chevron bracing.

Although the present invention has been described with reference to specific embodiments, also shown in the appended figures, it will be apparent for those skilled in the art that many variations and modifications can be done within the scope of the invention as described in the specification and defined in the following claims.

Description of the reference numerals used in the accompanying drawings according to the present invention:

| Reference Numerals | Description |
|---|---|
| 100 | Viscoelastic bracing clamper |
| 101 | Cylinder |
| 102 | Inner core |
| 103 | Joint |
| 104 | Front connector |
| 105 | Stopper |
| 106 | End connector |
| 107 | Damping means |

We claim:

1. A viscoelastic bracing damper (100) for attaching to a pair of diagonally-opposed beam-column joints of adjacent floors of a building structure to absorb dynamic or vibrational loads caused by wind or an earthquake, the viscoelastic bracing damper (100) comprising:

a cylinder (101);

an inner core (102) extending through the cylinder (101) without contacting an inner surface of the cylinder (101), thereby forming a barrel portion between the inner surface of the cylinder (101) and the inner core (102);

a joint (103) connecting a front connector (104) to one end of the inner core (102), the front connector (104) being for connecting the viscoelastic bracing damper (100) to one of the pair of beam-column joints of adjacent floors of the building structure;

a stopper (105) connected to an opposite end of the inner core (102) and passing through an opening in an end connector (106) to limit excess lateral movement of the building structure during vibration, the end connector (106) being for connecting the viscoelastic bracing damper (100) to the other of the pair of beam-column joints of adjacent floors of the building structure; and a damping means (107) extending substantially along a length of the barrel portion;

wherein the damping means (107) is compressed between the inner surface of the cylinder (101) and the inner core (102) for absorbing vibration loads and is bonded to the inner surface of the cylinder (101) and to the inner core (102).

2. The viscoelastic bracing damper (100) according to claim 1, wherein the damping means (107) is a viscoelastic material.

3. The viscoelastic bracing damper (100) according to claim 2, wherein the viscoelastic material comprises rubber.

* * * * *